United States Patent [19]

Wilimczik

[11] Patent Number: 4,884,957

[45] Date of Patent: Dec. 5, 1989

[54] DISPLACEMENT MACHINE HAVING DISPLACEMENT BODY AND SEALING MEMBERS ROTATING ON NON-PARALLEL AXES

[76] Inventor: Wolfhart Wilimczik, Winterstrasse 11, 8037 Olching, Fed. Rep. of Germany

[21] Appl. No.: 177,659

[22] PCT Filed: Jul. 11, 1986

[86] PCT No.: PCT/EP86/00411

§ 371 Date: Mar. 7, 1988

§ 102(e) Date: Mar. 7, 1988

[87] PCT Pub. No.: WO88/00642

PCT Pub. Date: Jan. 28, 1988

[51] Int. Cl.[4] ..... F01C 3/06; F04C 3/00

[52] U.S. Cl. ..... 418/16; 418/77; 418/166; 418/195; 417/356

[58] Field of Search ..... 418/77, 164, 166, 195, 418/16, 20; 417/356

[56] References Cited

U.S. PATENT DOCUMENTS 4,548,559 10/1985 Willimczik ..... 418/195

FOREIGN PATENT DOCUMENTS 2913608 11/1980 Fed. Rep. of Germany ..... 418/195
3308434 9/1984 Fed. Rep. of Germany .
3513073 11/1986 Fed. Rep. of Germany .
2133473 7/1984 United Kingdom ..... 418/77

*Primary Examiner*—John J. Vrablik
*Attorney, Agent, or Firm*—Henry M. Feiereisen

[57] ABSTRACT

The displacement machine includes a casing (1) closed by an end plate (2) and accommodating a rotor with displacement surfaces with which a seal is engaged in form-locking manner to co-rotate therewith. The displacement surfaces sealingly engage a hollow (5) which defines the working space and is concentric to the rotational axis (3) of the rotor whereby the hollow (5) is provided in the rotor-facing end face (6) of the casing (1). The end face (6) defines with the rotational axis (3) of the rotor an angle deviating from 90°. The rotor is a displacement body (4) filling out and covering the hollow (5) with at least one recess according to a section along an axis parallel plane or curved area intersecting the hollow (5) wherein the surface parts of the displacement body (4) projecting into the hollow (5) define the displacement surfaces (4*a*). Arranged in each recess is a sealing element (7) which bears against the displacement surfaces (4*a*) along a sealing line. All the sealing elements (7) define the co-rotating seal.

20 Claims, 12 Drawing Sheets

Figure 1:
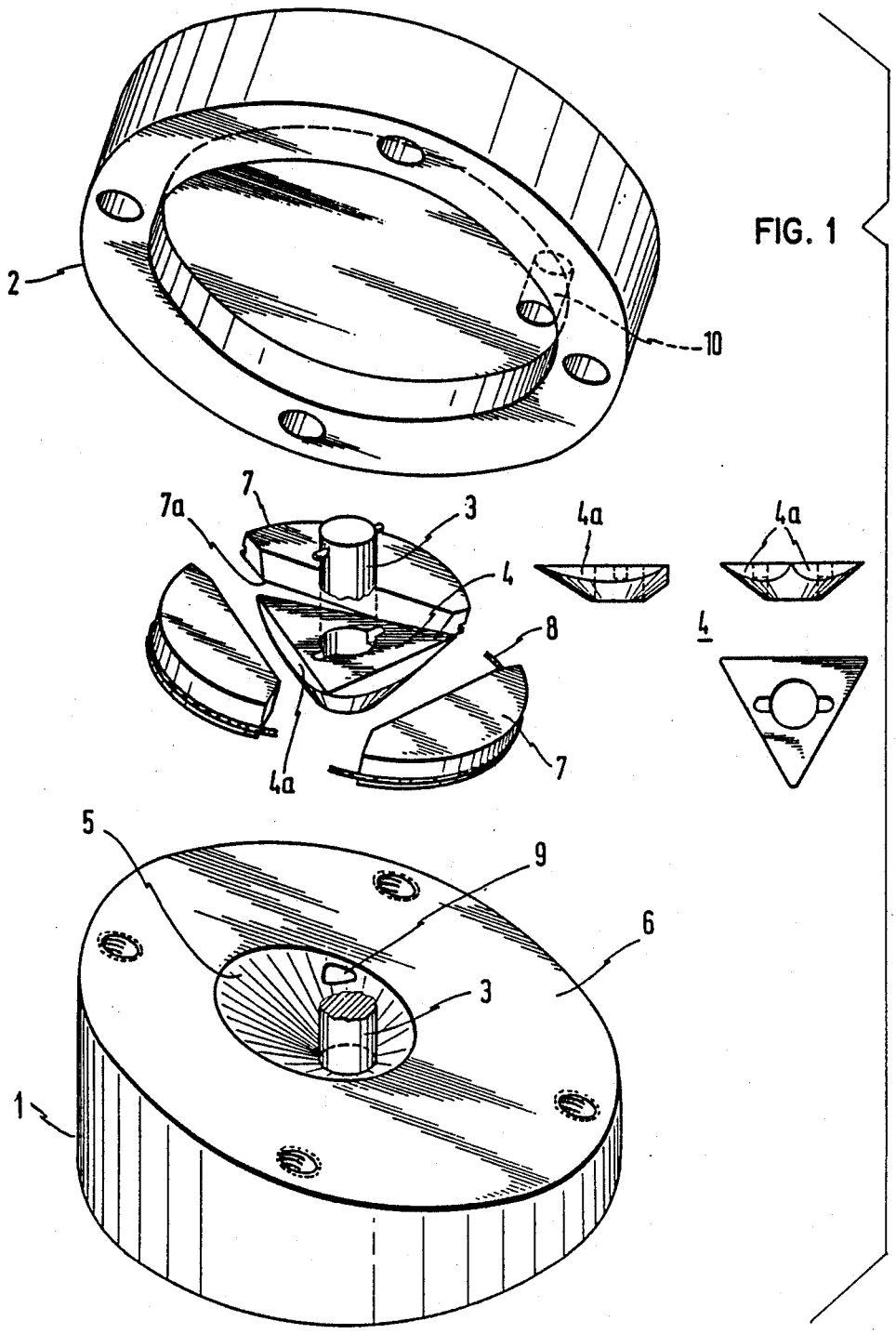

FIG. 3a
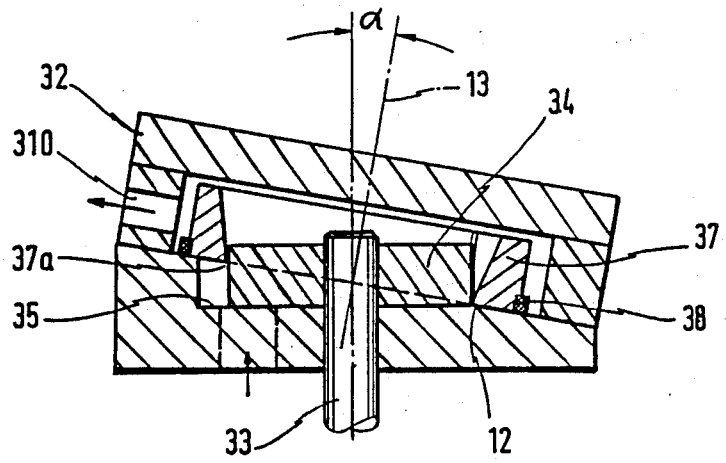
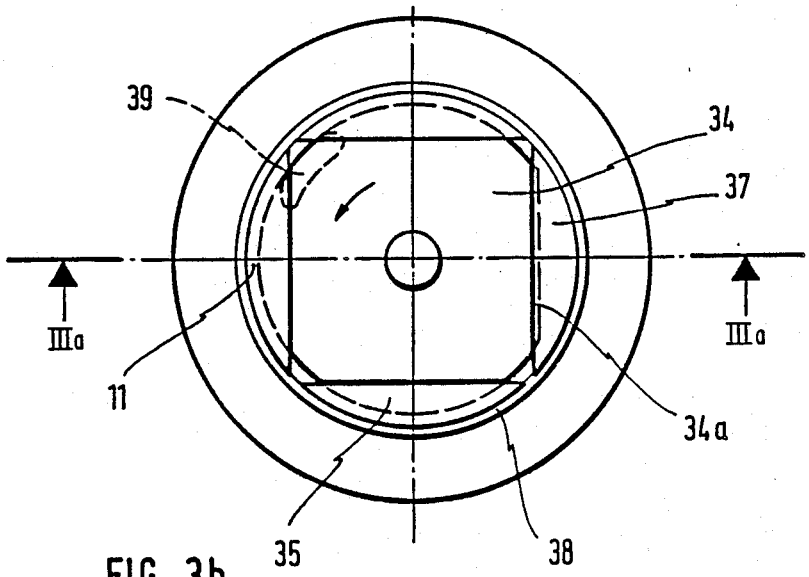
FIG. 3b

FIG. 4a
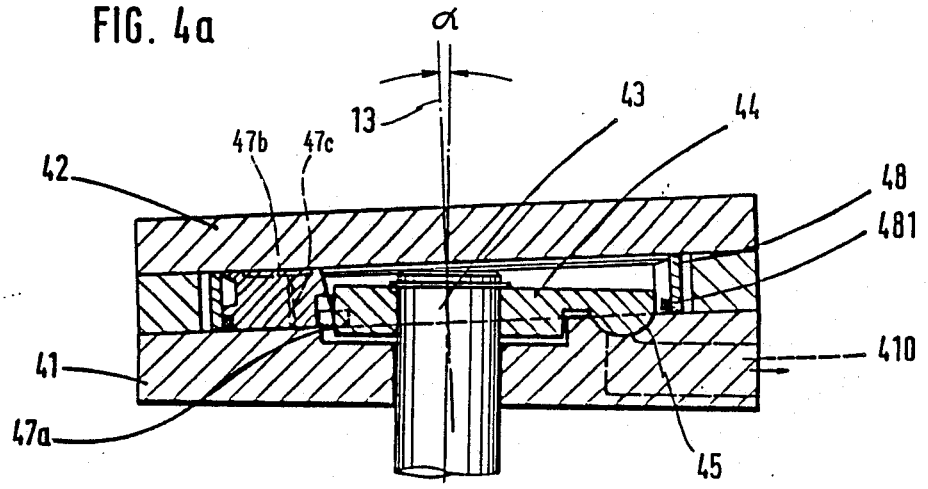
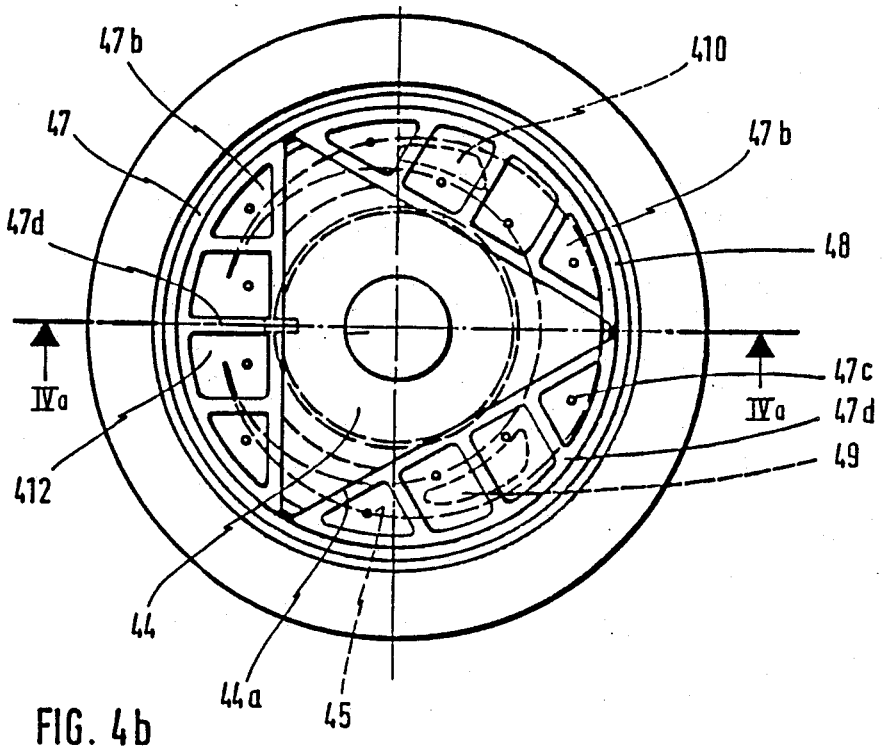
FIG. 4b

FIG. 12a
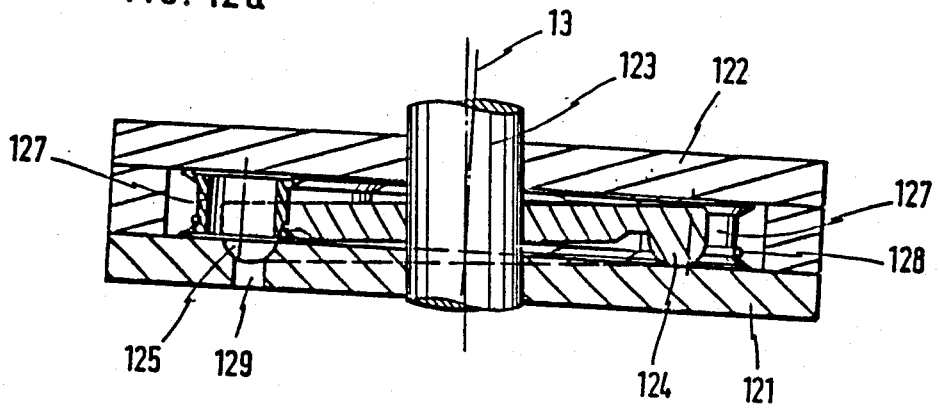
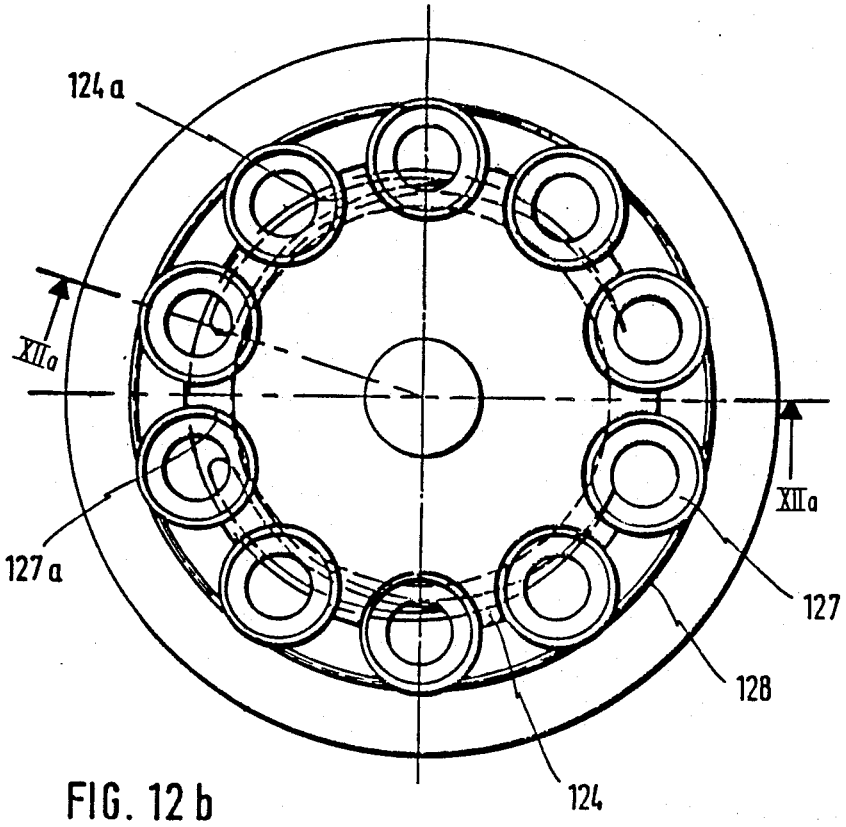
FIG. 12b

FIG. 14 a
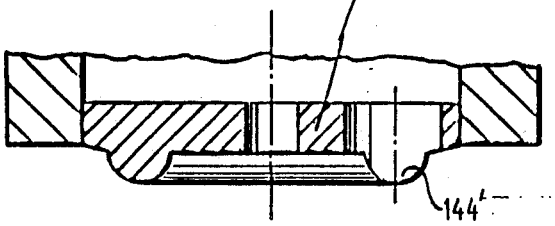
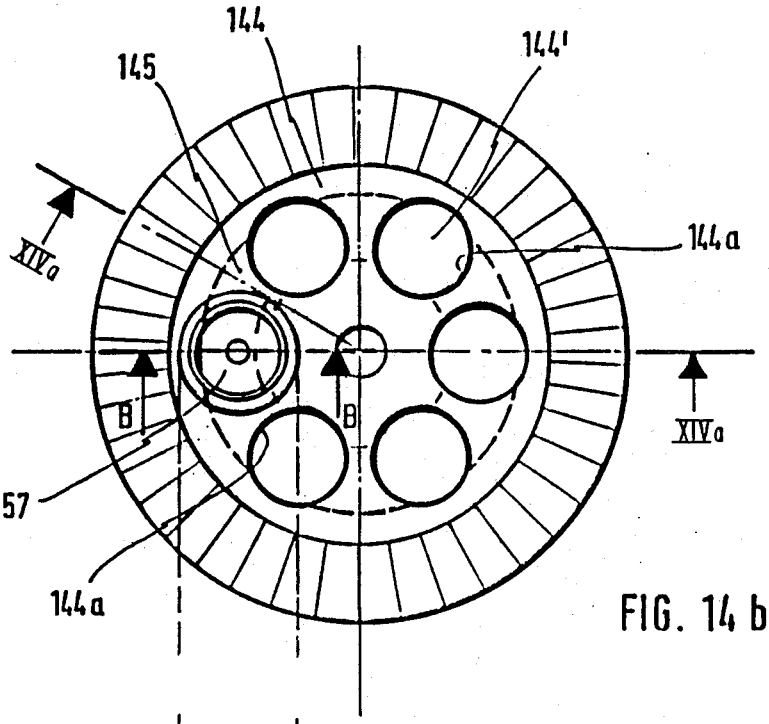
FIG. 14 b
FIG. 15 a
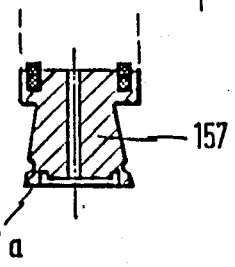
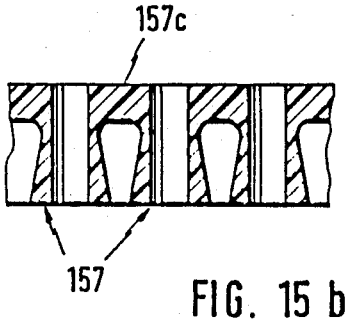
FIG. 15 b

DISPLACEMENT MACHINE HAVING DISPLACEMENT BODY AND SEALING MEMBERS ROTATING ON NON-PARALLEL AXES

DESCRIPTION

The invention refers to a displacement machine of a rotary pump type which includes a casing closed by an end plate and accommodating a rotor with displacement surfaces with which a seal is in form-locking engagement to co-rotate therewith. The displacement surfaces sealingly engage a hollow which defines the working space and is concentric to the rotational axis of the rotor whereby the hollow is provided in the rotor-facing end face of the casing. The end face defines with the rotational axis of the rotor an angle deviating from 90° so that the cross sectional area of the hollow varies between a maximum value and a minimum value. The seal rotates on an inclined end face of the casing about an axis inclined about a small angle relative to the rotational axis of the rotor and intersecting this axis.

Such a displacement machine is known e.g. from the DE-PS No. 29 13 608 and may selectively run in both rotational directions as pump or as motor with any, even highly viscous and/or abrasive fluids. The rotor is provided with four vanes having parts projecting into the hollow to define the displacement surfaces. The vanes of the rotor engage through slots of the seal which is designed as disk so that this slotted sealing disk is moved with the rotation of the rotor. There is, however, a kinematic problem because the shaft of the rotor and the axis about which the disk-like seal rotates define a (small) angle so that the right angle between successive vanes of the rotor varies in dependence on the respective rotational position between a value below 90° and a value above 90° upon projection on the plane in which the seal rotates, that is upon projection on the inclined end face of the casing. (As it is known, only the angle of 180° remains unchanged upon a oblique-angled projection). If the slots are made sufficiently broad in order to create space in view of positional variations of the vanes within these slots and caused for the above-stated reasons, the sealing action is impaired when the vanes and the disk-like seal are made of a rigid material. An elastic design of the vanes and/or the disk-like seal in circumferential direction limits, however, the range of application of this machine.

The invention is based on the object to create a displacement machine of the above-stated kind which maintains the same operating principle without encountering the above-stated problems and provides an even wider range of application for the machine.

This object is attained in accordance with the present invention in that the rotor is a displacement body filling out and covering the hollow with at least one recess according to a section along an axis parallel area intersecting the hollow wherein the surface parts of the displacement body projecting into the hollow define the displacement surfaces.

They are covered by the sealing edges of the seals. When referring to a recess, a displacement body of circular shape is to be understood from which a sector is cut out to obtain a respective displacement surface.

This solution has the advantage of a wide freedom of design with regard to the shape, position and number of displacement surfaces since to each recess one separate sealing element is assigned so that the sealing elements execute the slight shifting motions encountered during the course of a revolution independent of each other.

According to a preferred embodiment, several recesses are provided which are uniformly spaced about the circumference of the displacement body and result in a corresponding number of displacement surfaces leading to a very low pulsation of the machine.

In the simplest case, the displacement body—as viewed in top view—has the contour of a polygon with its axis parallel sides defining the displacement surfaces.

In the most common case, however, the area generating the recess is a surface of a body of revolution, preferably a cylindrical surface.

The axis of the body of revolution generating the recess in the displacement body may extend outside, in or inside the hollow so that the recess is located at the outer circumference, in the displacement body or at its inner circumference. In the first mentioned case, the displacement body then has in top view a contour similar to a chain gear, in the latter case the respective contour at the inner circumference while upon an axis of the generating body of revolution located within the hollow the recess or recesses have the shape of holes in the displacement body. It will be recognized that the bent, circular arc-like shape of the recesses in the mentioned first case and in the stated last case allows a wider width of the hollow in the casing relative to a plane design of the recesses and thus a wider operating volume.

In general, the hollow has the shape of an annular groove of basically arbitrary, suitable contour. The hollow may, however, extend to a shaft connected in non-rotational manner with the displacement body and thus has no inner wall constituted by the material of the casing.

This embodiment can be developed in such a manner that the hollow is shaped in form of a spherical shell and that the shaft connected in non-rotational manner with the displacement body is swingably supported in the casing. In this design, the displacement machine during operation has a variable chamber volume which increases with increasing angle between the drive shaft of the displacement body and the axis about which the sealing elements rotate.

There is further the possibility to divide the available cross section of the working space into at least two concentric hollows (annular grooves). Then, the machine can be used for transformation of hydraulic and pneumatic magnitudes e.g. for pressure increase or as hydraulically driven pump or compressor. The drive shaft of the displacement body can be omitted in this case.

In all embodiments, each recess is assigned to a sealing element which is retained in linear engagement with the displacement surfaces and co-rotates therewith. In case the recesses between the displacement surfaces have the shape of holes, the sealing elements are circular disks or cylinders which circulate with oblique axis relative to the shaft of the rotor and therefore slowly rotate in view of the different frictional forces prevailing at their inner circumference and their outer circumference. This is favorable for the break-in process between the participating sliding surfaces and prevents the formation of grooves in circumferential direction of the displacement body e.g. between the upper side of the sealing elements and the inner surface of the end plate of the casing.

The sealing elements can be retained by a common clamping ring in engagement with the displacement surfaces, especially when the recesses are provided at the outer circumference of the displacement body.

An improvement is accomplished by arranging between the clamping ring and the sealing elements additional resilient elements which individually load the sealing elements.

Since the displacement machine allows very high pressures (more than 100 bar with water), the sealing elements should have hydrostatic relief bores which connect sealed pockets of equal size on opposing large areas of the sealing elements.

In order to compensate wear, the end faces of the sealing elements facing the end face of the casing and the inner surface of the end plate are parted rectangularly to their longitudinal axis and accommodate an elastic element in axial direction whereby the hydrostatic pressure is completely maintained. In any event, the parts of the sealing element should be sealingly connected with each other.

Without surrendering the concept of sealing elements movable independently of each other, the latter can be connected at the end plate side area of their end face to a one-piece molding by preferably elastic webs since the motions executed by the individual sealing elements relative to each other are very small when considering the small slant angles used in practice of usually less than 10°.

It is also possible to combine the individual seals and to connect them to one external shaft.

Finally, the displacement machine offers, in particular in the embodiment with displacement surfaces provided within the displacement body or at its inner circumference, the possibility of the contactless drive, e.g. by embedding permanent magnets in the area of the outer circumference of the displacement body or by designing it as squirrel-cage rotor of an electromotor.

The proposed displacement machine has a very broad field of application which may range from pumps and compressors for liquids and gases to compressed air motors, retarders, flow meters, hydrostatic couplings and displacement turbines. Combinations are also possible not only of the individual embodiments but also with other machines as e.g. a turbo-machine in a manner that the displacement body is designed at its outer circumference as impeller of a circular pump or a turbine wheel.

Figure 2A:
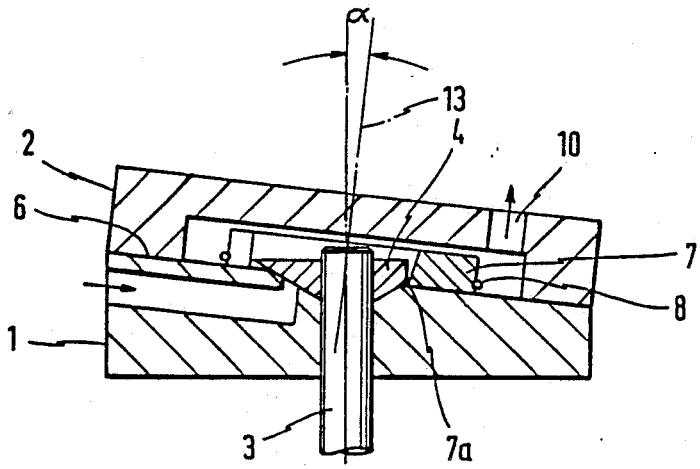
Figure 2B:
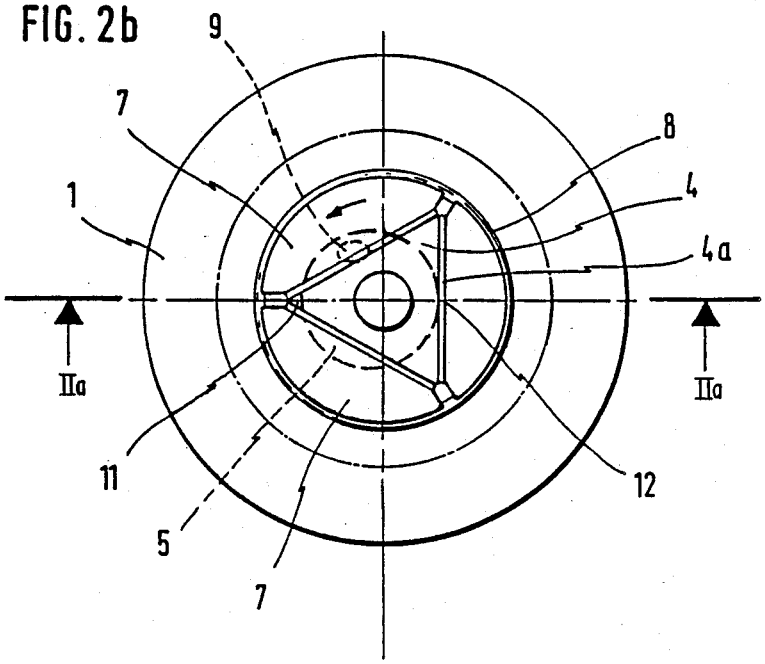
Figure 5A:
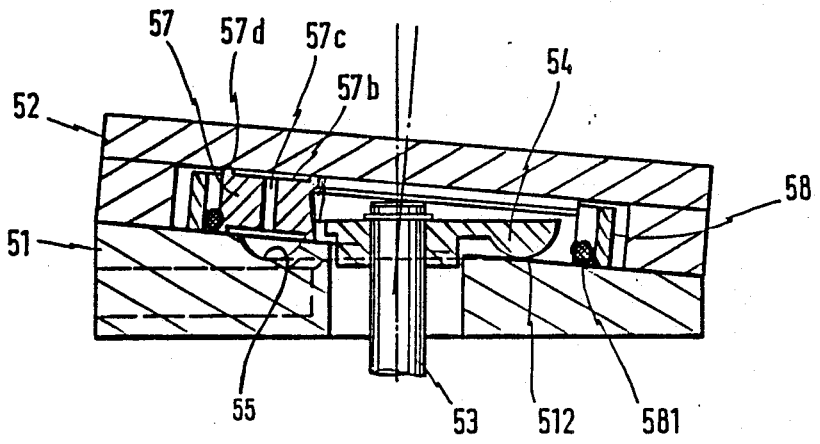
Figure 5B:
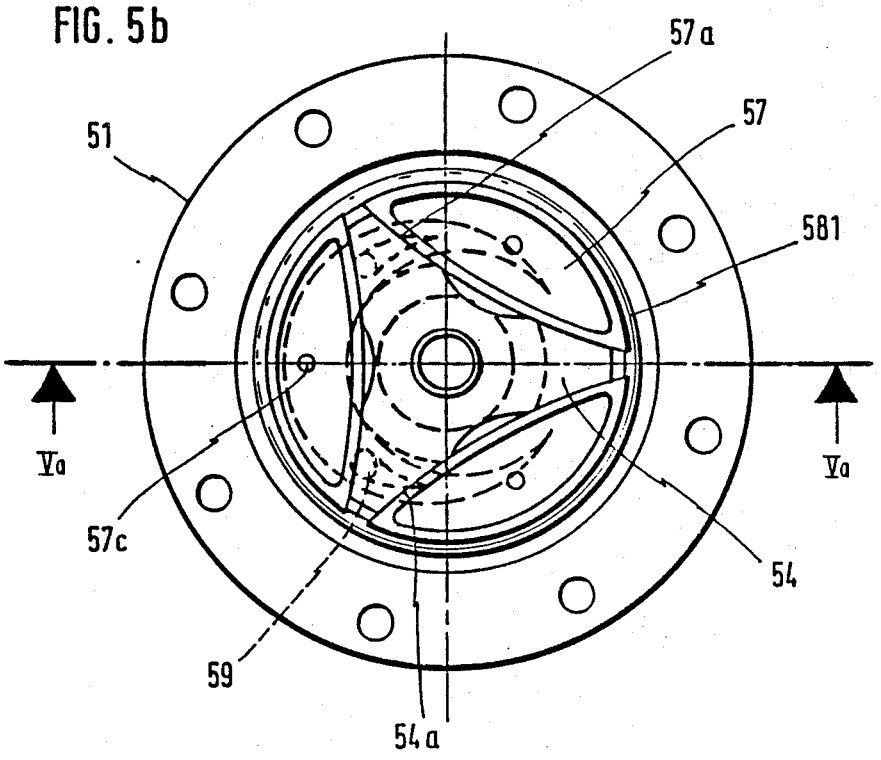
Figure 6A:
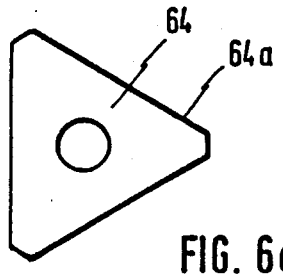
Figure 6B:
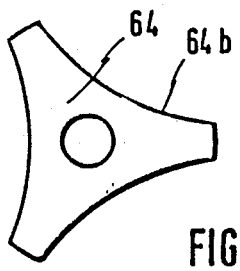
Figure 7A:
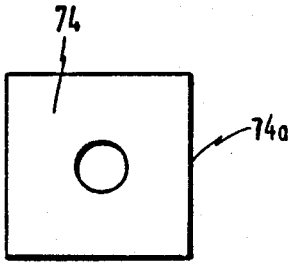
Figure 7B:
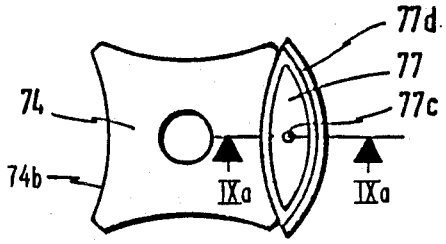
Figure 8A:
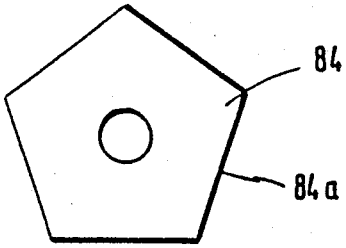
Figure 8B:
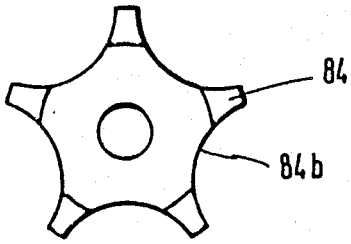
Figure 9A:
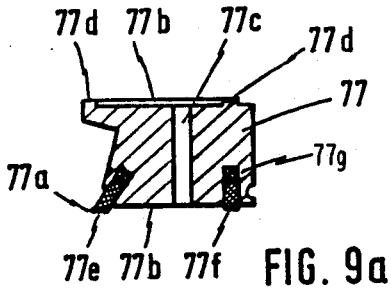
Figure 9B:
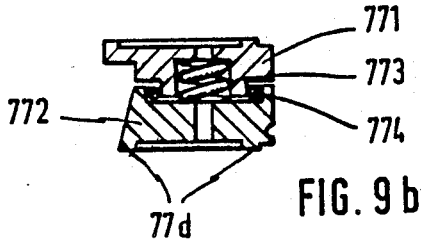
Figure 9C:
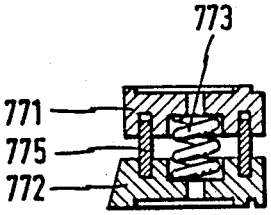
Figure 10:
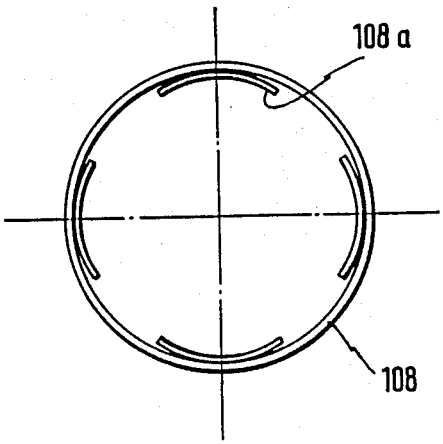
Figure 11A:
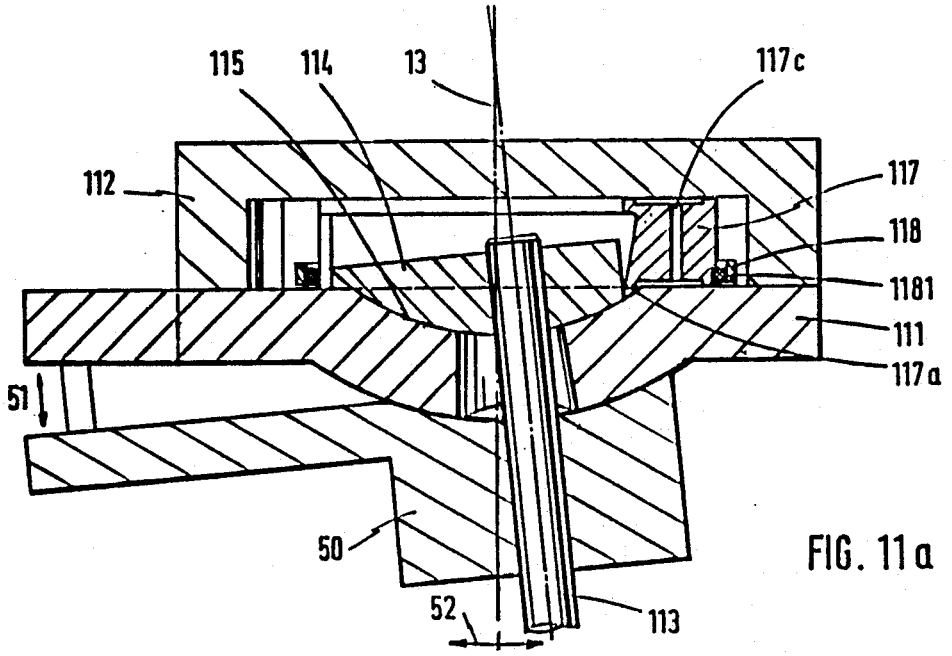
Figure 11B:
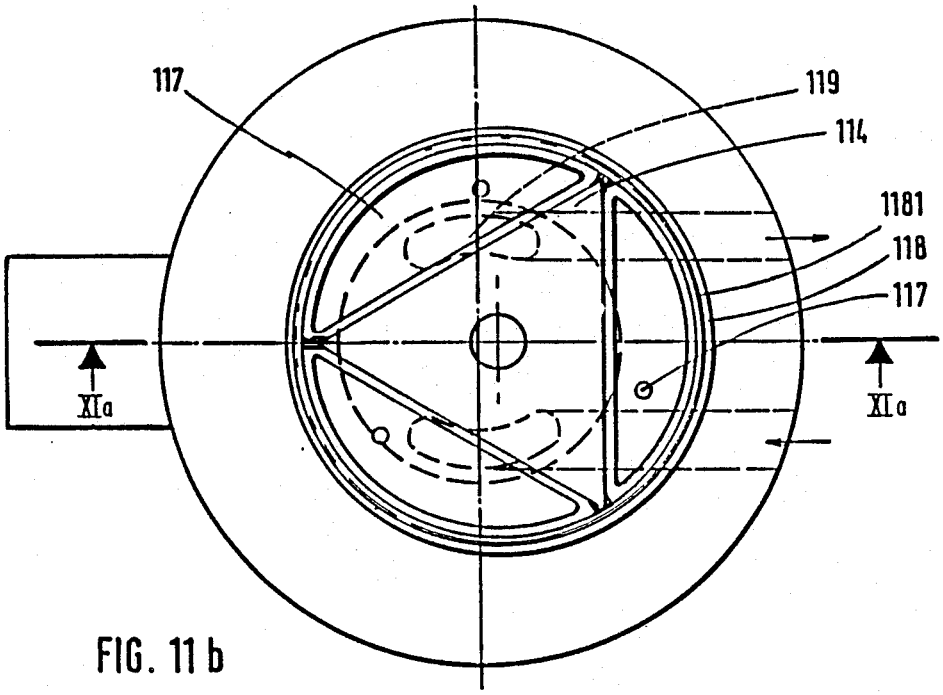
Figure 13:
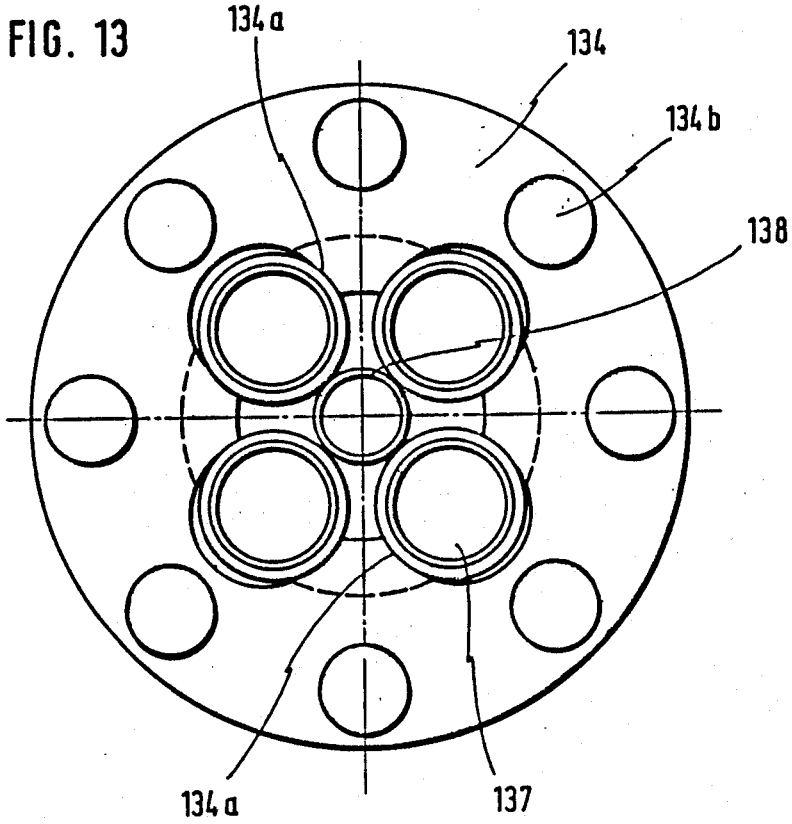
Figure 16A:
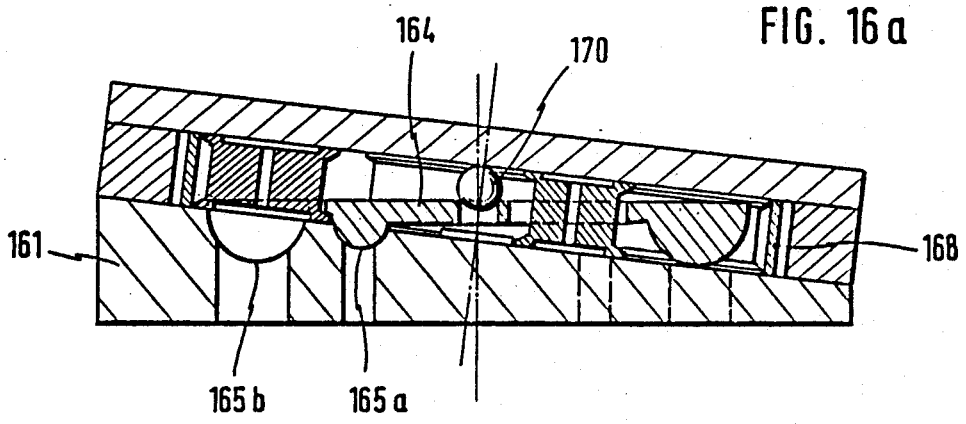
Figure 16B:
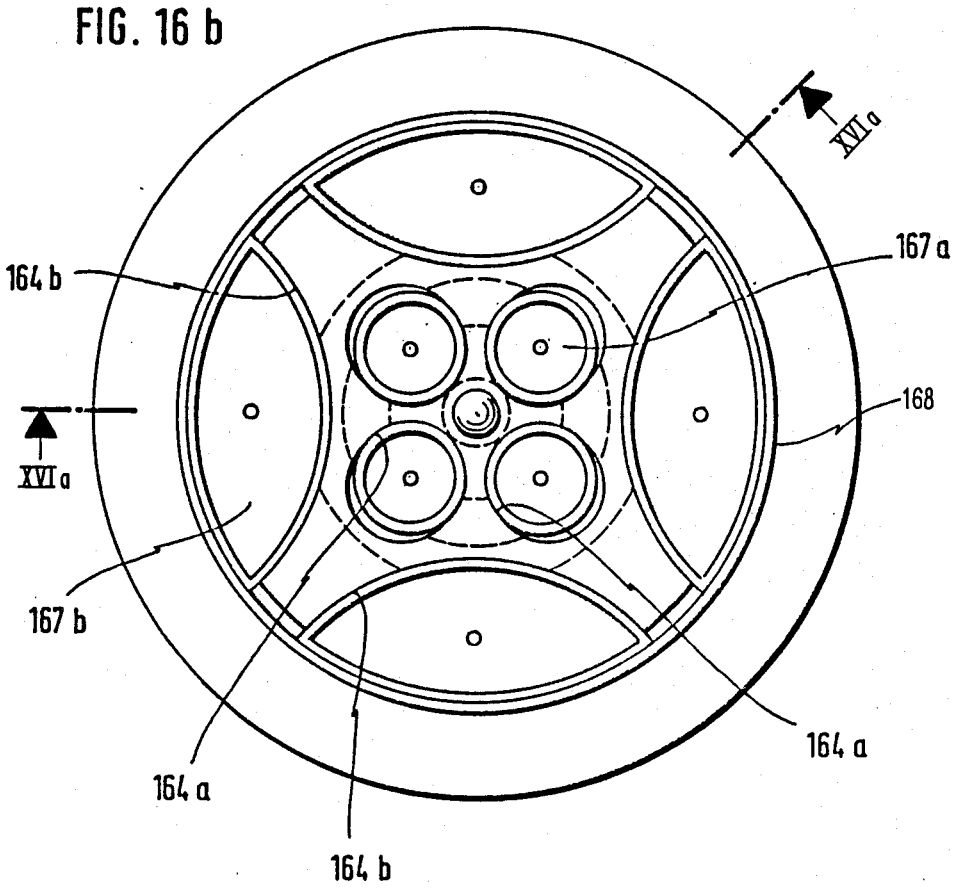

Various exemplified embodiments of the displacement machine according to the invention are schematically illustrated in simplified manner in the drawing in which:

FIG. 1 is a perspective illustration of a first embodiment with three-faced displacement body, FIGS. 2*a*, 2*b* are a sectional view and a top view of the first embodiment, FIGS. 3*a*, 3*b* are a sectional view and a top view of a second embodiment with four-faced displacement body, FIGS. 4*a*, 4*b* are a sectional view and a top view of a further development of the first embodiment especially suitable for high pressures, FIGS. 5*a*, 5*b* are a sectional view and a top view of a further development of the first embodiment improved with regard to the capacity and usable for high pressures, FIGS. 6*a*, 6*b* show a three-faced displacement body with straight and concave displacement surfaces, FIGS. 7*a*, 7*b* show a four-faced displacement body with straight and concave displacement surfaces with a sealing element bearing against one displacement surface, FIGS. 8*a*, 8*b* show a five-faced displacement body with straight and concave displacement surfaces, FIGS. 9*a* to 9*c* are a sectional view of three embodiments of the sealing element in FIG. 7*b* taken along the line IXa—IXa, FIG. 10 is a top view of an embodiment of an outer clamping ring for use in connection with a four-faced displacement body, FIGS. 11*a*, 11*b* are a cross sectional view and a top view of a third embodiment of the displacement machine with changeable volumetric displacement, FIGS. 12*a*, 12*b* are a cross sectional view and a top view of a fourth embodiment of the displacement machine with especially low degree of pulsation, FIG. 13 is a top view of a fifth embodiment in which the displacement body is electromagnetically driven (without contact), FIGS. 14*a*, 14*b* are a sectional view and a top view of a sixth embodiment, FIG. 15*a* is a sectional view of a sealing element for the sixth embodiment, FIG. 15*b* is a sectional view of a modification of the sealing element, FIGS. 16*a*, 16*b* are a sectional view and a top view of a seventh embodiment of the displacement body with concentric annular grooves.

The displacement machine illustrated in FIGS. 1 to 2*b* includes a casing 1 closed by an end plate 2 and supporting a shaft 3 which is connected in non-rotational manner with a displacement body 4. The displacement body 4, which on the right hand side of FIG. 1 is illustrated in two side views and a top view, runs in a hollow 5 of the casing 1 the shape of which is obtained by initially hollowing a cone which extends toward the bore of the shaft 3 concentric to this bore and then by slantingly slicing this area to a degree that the illustrated inclined end face 6 of the housing 1 is obtained with the hollow 5 contained therein. Placed on this end face 6 is the end plate 2 and threadably engaged therewith. In the top view, the displacement body 4 has the shape of an equal-sided triangle with lateral surfaces partly protruding in the hollow 5 and defining the displacement surfaces 4*a*. A sealing element 7 is assigned to each displacement surface 4. The sealing elements 7 run with their lower large areas on the end face 6 of the casing 1. Their lateral surfaces facing the displacement surfaces 4 are bevelled in such a manner that a line contact along the edge 7*a* at the level of the end face 6 of the casing 1 is obtained between each displacement surface 4*a* and the pertaining sealing element 7. By means of a clamping ring 8, the sealing elements 7 which are of circular segment shape in top view are retained with their straight edges 7*a* in engagement with the respective displacement surfaces of the displacement body 4. In order to keep the tilting moment as small as possible, the clamping ring 8 is arranged on the circumference of the circular segment-shaped sealing elements 7 as close as possible to their lower large area where also the respective counterforce acts on the sealing edges 7*a*.

Extending into the hollow 5 is an inlet channel 9. The end plate 2 accommodates an outlet channel 10. The hollow 5 and the lower large areas of the sealing elements 7 limit a working space the cross section of which being at a maximum at the circumferential area 11 and at a minimum at the circumferential area 12 (in the shown example equal zero). Upon rotation of the arrangement comprising the displacement body 4 and the sealing elements 7 in direction of the arrow as shown in FIG. 2*b*, the fluid entering the working space via the inlet channel 9 and displaced therein by the respective displacement surface escapes at slight lift of the respective sealing element 7 into the superimposed space enclosed by the end plate 2 which extends at a distance from the sealing body 7 as shown in FIG. 2*a* and from there via the outlet channel 10. The thus obtained feed pressure urges at the suction side the displacement body 4 and the sealing elements 7 against the sliding surfaces thereby achieving a good sealing action.

By arranging the outlet channel 10 externally on the end plate 2, a certain circular pump effect is additionally achieved. Although the sealing elements 7 circulate about a rotational axis 13 which in accordance with FIG. 2*a* defines a small angle with the drive shaft 3 of the displacement body 4 (that is the angle by which the end face 6 deviates from a plane rectangular to the shaft 3), the exactly straight sealing edges 7*a* of the sealing elements 7 remain in each rotational position in engagement with the respective exactly plane displacement surface 4*a*. In view of its high tightness, this embodiment of the displacement machine is suitable as pump for small and very small capacities, is safe to run dry in the pressureless state and has a considerable intake capability. The displacement machine can be used e.g. as pump for windshield washing units for motor vehicles, as lubricating oil pump or as vacuum pump. The worn out surfaces are self-adjusting.

FIGS. 3*a* and 3*b* illustrate a second embodiment of the displacement machine, the difference to the first embodiment residing in the displacement body 34 which in top view is now approximately square, thus has four displacement surfaces 34*a* cooperating accordingly with four sealing elements 37 which in top view are of circular segment shape. Furthermore, instead of a conical hollow a cylindrical hollow 35 is provided by which the casing limits the working space. The hollow 35 can also be considered as an annular groove concentric to the drive shaft 33 with an inner diameter equal zero or with a groove base extending to the shaft 33. The position of the outlet channel 310 in the end plate 32 is basically arbitrary. As in the case of the first embodiment, the sealing elements 37 retained in engagement with the displacement body 34 by a common elastic clamping ring 38 act as check valves. The design of the displacement machine has a smaller pulsation than the embodiment according to the FIGS. 1 to 2*b* and otherwise has about the same properties as the first embodiment.

FIGS. 4*a* and 4*b* show a further development of the first embodiment suitable for highest pressures. The hollow has the shape of an annular groove 45 in the shape of a semicircular arc. Extending into this annular groove 45 are the inlet channel 49 as well as the outlet channel 410. In the area 412, the volume of the working space or its cross section, respectively, is zero. The displacement body 44 which in top view is again of triangular shape has displacement surfaces 44*a* contoured in accordance with the annular groove 45 and cooperates with three hydrostatically relieved sealing elements 47. Therefore, the sealing elements 47 are provided at both its upper side and its underside with several pockets 47*b* which preferably are precisely equal in area and are connected with each other via bores 47*c*. The remaining parts of the large areas of the sealing elements 47 define sealing webs 47*d* which seal the pockets 47*b* relative to each other together with the end face of the casing 41 and the inner surface of the end plate 42, respectively. The sealing elements 47 are retained with their sealing edges 47*a* against the displacement surfaces 44*a* of the displacement body 44 by means of a clamping ring 48 and an O-ring 481 which is incorporated in a groove of the sealing elements 47. The feed pressure does not exert any forces onto the clamping ring 48. Also the displacement body is subjected to only small axial forces. This design of the displacement machine is thus suitable as hydraulic pump or hydraulic engine for very high pressures in the range of 1000 bar.

Another further development of the first embodiment of the displacement machine is shown in FIGS. 5*a* and 5*b*. The again triangular displacement body 54 has displacement surfaces 54*a* which in top view are of circular arc shape and are contoured in correspondence to the hollow 55 which is also in form of an annular groove in the shape of a semicircular arc. In the area 512, the volume of the working space or its cross section, respectively is zero. Adjusted to the displacement surfaces 54*a* are sealing elements 57 which like in the case of FIGS. 4*a* and 4*b* have hydrostatic relief bores 57*c* and the respective sealed pockets 57*b* on both large areas i.e. upper side and underside of the sealing elements 57. In comparison to the embodiment with straight displacement surfaces, the circular arc shape of the displacement surfaces allows an enlargement of the working space with a maximal width which cannot exceed the difference between the radius of the circle circumscribing the displacement body and the radius of the circle inscribing the displacement body. In this development with increased volumetric displacement, the approximately lens-shaped sealing elements 57 bear along a sealing line 57*a* on the respective displacement surface. The inaccuracies caused by the bent sealing line are extremely small and are eliminated after a short break-in time during which a profiling of the displacement surface 54*a* is obtained with the sealing line 57*a* continuously bearing over its entire length against the displacement surface in case such a profiling was not provided during the production. The sealing elements 57 are retained in engagement with the displacement body 54 by an elastic clamping ring 58 and O-ring 581.

FIGS. 6*a* and 6*b* show one more time the difference between a displacement body 64 triangular in top view with straight displacement surfaces 64*a* and displacement surfaces 64*b* of circular arc shape in top view.

FIGS. 7*a* and 7*b*, respectively, and 8*a* and 8*b*, respectively, illustrate further examples of displacement bodies 74 and 84 which in top views are tetragonal, pentagonal or polygonal and may be provided with either rectilinear displacement surfaces 74*a*; 84*a* or with curved displacement surfaces 74*b*; 84*b*.

FIG. 7*b* shows additionally one of the thus lens-shaped sealing element 77 the sectional view of which along the line IXa—IXa is illustrated in FIG. 9*a*. On both its large areas, this sealing element has sealed pockets 77*b* which are connected with each other by a bore 77*c* for hydrostatic relief. While the sealing action is accomplished on the upper large area through remaining webs 77*d*, sealing strips 77*e* and 77*f* are embedded in the edges of the lower large areas with the sealing strip 77*e* simultaneously defining the sealing edge 77*a* which bears on the respective sealing surface of the displacement body 74 (FIG. 7*b*). Adjacent to the sealing strips 77*c* and 77*f* are O-rings 77*g*.

FIG. 9*b* shows an improvement of this sealing element. While in case of FIG. 9*a* the sealing strips 77*e* and 77*f* are supported preferably by O-rings for wear compensation, in the development according to FIG. 9*b* the sealing strips also of the lower large area are designed as remaining webs while the sealing element is made of two parts 771 and 772 between which a helical pressure spring 773 is arranged. An O-ring 774 provides a tight connection between both parts 771 and 772; however, still allows the change of length and width attained by the spring 773 and necessary for wear compensation. Thus, a very broad adjusting range is created. The same axially elastic design of the sealing elements is feasible also in all other embodiments.

FIG. 9*c* shows a further embodiment of an axially elastic sealing element which is made of two parts 771 and 772 connected to each other via a sleeve-like intermediate member 775 in such a manner that the upper part 771 is elastically slidable in axial direction relative to the lower part under the action of a helical pressure spring 773 arranged between both parts whereby the sleeve-like intermediate member maintains the tight connection between the parts 771 and 772. This embodiment of the sealing element is suitable for highly abrasive fluids whereby the hydrostatic pressure compensation is completely maintained.

As already mentioned, the relative displacements of the sealing elements are extremely small so that the clamping ring as e.g. 38 in FIGS. 3*a* and 3*b* require only a very low elasticity i.e. need not be of dimensional stability and may be made of metal.

FIG. 10 shows an embodiment in which the actual clamping ring 108 supports additional internal leaf springs or bow springs 108*a* which provide the contact pressure of the respective sealing element on the displacement body and in this manner compensate the wear. The illustrated exemplified embodiment is provided for a four-faced displacement body.

FIGS. 11*a* and 11*b* show an embodiment of the displacement machine which is similar to the one of FIGS. 1 to 2*b*, however, with changeable capacity. The hollow 115 has the shape of a spherical shell; the displacement body 114 thus has the contour of a spherical calotte. The shaft 113 is received in an only schematically illustrated swing bearing 50 which is swingable according to arrow 51 in accordance with arrow 52. Through the swinging motion, the angle between the shaft 113 and the axis 12 about which the sealing elements 117 move is changed thereby altering the volume of the working space. At an angle of 0°, the delivery is zero. In this embodiment, the displacement machine is suitable e.g. as a hydraulic pump with variable stroke volume during the run. Like in the other embodiments, a clamping ring 118 retains via an O-ring 1181 the sealing elements 117 with their sealing edges 117*a* in engagement with the displacement body 114. The opening 119 in the hollow 115 can define e.g. the inlet channel.

FIGS. 12*a* and 12*b* show an embodiment of the displacement machine which is suitable as hydraulic motor with very high torque at very low pulsation. The high torque is solely obtained by designing the working space in form of an annular groove 125 with relatively large diameter without increasing the absorption capacity and thus the power. The small pulsation is based—independently therefrom—on the use of a displacement body 124 with ten circular arc shaped displacement surfaces 124*a* cooperating with ten sealing elements 127. The sealing elements 127 which as already stated are hydrostatically pressure-relieved have the shape of cylinders and are retained by a clamping ring 128 in engagement with the respective displacement surfaces. The sealing edge 127*a* is produced through recessing of the sealing elements in their central part. Through suitable material selection, a slight elasticity of the sealing edge 127*a* can be achieved; at respective profiling of the displacement surfaces 124*a*, they may, however, be rigid. During operation of the displacement machine, the sealing elements 127 rotate slowly about their symmetrical axis thereby countering a grooving (e.g. by a foreign substance between the sealing surfaces). Inlet channel and outlet channel are arranged very closely adjacent to each other—according to the distance of successive displacement surfaces 124*a*. As hydraulic motor, this displacement machine may be used also for the water hydraulic.

A further embodiment of the displacement machine is shown in FIG. 13. In this embodiment, the displacement surfaces 134*a* of the displacement body 134 are also circular arc-shaped, however, are inwardly directed and cooperate with sealing elements 137 which are designed like the sealing elements 127 in FIGS. 12*a* and 12*b*. An internal clamping ring 138 retains the sealing elements 137 in engagement with the displacement surfaces 134*a*. The displacement body 134 is driven contactless, thus is not connected with the drive shaft. Rather, permanent magnets 134*b* are embedded in its outer circumference and define the one part of a magnetic coupling the other non-illustrated part of which being located outside of the not shown casing of the displacement machine. This design is thus suitable as hermetically tight pump. In like manner, the displacement body can be designed as squirrel-cage rotor of an electromotor and thus is also driven in contactless manner.

FIGS. 14*a* and 14*b* show an embodiment of a displacement body 144 designed as a circular disk which has six bores 144 above the annular groove 145 defining the working space whereby the wall section of each bore respectively arranged above the annular groove and protruding in the latter acts as displacement surface 144*a*. A sealing element 157 is disposed in each bore as illustrated in sectional view by way of example in FIG. 15*a* in a pressure-relieved design. Also this embodiment is suitable for very high pressures since only small axial and radial forces act on the displacement body 144.

Upon mostly small slant angles of less than 10°, the individual sealing elements shift relative to each other only to a small degree. They may thus be embedded in a common elastic ring or be connected in one piece via webs 157*c* in accordance with FIG. 15*b*, provided the sealing elements 157 are made of a suitable elastic material. This embodiment is especially suitable for simple, inexpensive pumps. In case the sealing elements are connected with each other in this manner via the displacement body, the axial pressure relief bores can be made of such size that the inlet channel as well as the outlet channel can be arranged in the end plate and the pumping fluid thus can flow from the inlet via the bore and the hollow to the outlet channel. Consequently, there is no need to provide the hollow with the inlet port and the outlet port.

FIGS. 16*a* and 16*b* illustrate a further embodiment of the displacement machine which is suitable in the transformation of hydraulic and pneumatic magnitudes and may find application e.g. for pressure increase or as hydraulically driven pump or compressor. In the casing 161 two concentric annular grooves 165*a* and 165*b* are arranged in which the displacement body 164 engages with four displacement surfaces 164*a* and 164*b*, respectively. The displacement body has no drive shaft and is only secured against falling out by a sphere 170. Above the outer annular groove 165*b* of larger cross section are four lens-shaped displacement bodies 167*b* which are urged against the respective displacement surfaces 164*b* by an outer clamping ring 168. Both annular grooves define separated working spaces with separated inlet and outlet channels (illustrated in the Figures slightly offset).

In this embodiment, the outer part of the displacement machine can work as hydraulic motor and the inner part as hydraulic pump whereby the pressure is increased in accordance with the ratio of the volume of the working spaces. According to another possibility, water under pressure can be admitted to the inner annular groove so that the inner part defines the drive of the outer part which acts as pump or compressor.

I claim:

1. A displacement machine, comprising:

a casing having one end face provided with a hollow defining a working space;

an end plate closing said casing;

a displacement body accommodated in said casing and rotatable about a rotational axis, said displacement body having displacement surfaces engaging said hollow which extends concentric to said rotational axis of said displacement body and is arranged in said end face of said casing, said end face defining with said rotational axis of said displacement body an angle deviating from 90° so that said hollow has a cross sectional area which varies between a maximum value and a minimum value, said displacement body filling out and covering said hollow and having surface parts projecting into said hollow to define said displacement surfaces which are uniformly spaced about the circumference of said displacement body, with each of said displacement surfaces being defined by a section along an axis parallel area intersecting said hollow; and sealing means bearing against said displacement surfaces so as to rotate therewith, said sealing means rotating on said end face of said casing about an axis inclined at a small angle relative to said rotational axis of said rotor and intersecting said axis thereby sealing said hollow.

2. A displacement machine as defined in claim 1 wherein said displacement body—as viewed in top view—has a contour of a polygon with its axis parallel sides defining said displacement surfaces.

3. A displacement machine as defined in claim 1 wherein said displacement surfaces are defined by a surface described by a body of revolution.

4. A displacement machine as defined in claim 3 wherein said displacement surfaces are defined by a cylindrical surface.

5. A displacement machine as defined in claim 3 wherein said body of revolution generating said displacement surfaces in said displacement body defines an axis extending outside of said hollow so that said displacement surfaces are located at the outer circumference of said displacement body.

6. A displacement machine as defined in claim 3 wherein said body of revolution generating said recess in said displacement body defines an axis extending in said hollow so that said recess is located in said displacement body.

7. A displacement machine as defined in claim 3 wherein said body of revolution generating said recess in said displacement body defines an axis extending within said hollow so that said displacement surfaces are located at the inner circumference of said displacement body.

8. A displacement machine as defined in claim 1, and further comprising a shaft connected in non-rotational manner with said displacement body, said hollow extending to said shaft.

9. A displacement machine as defined in claim 8 wherein said hollow is shaped in form of a spherical shell, and further comprising a swing bearing for swingably supporting said shaft in said casing.

10. A displacement machine as defined in claim 1 wherein said available working space has a cross section which is divided into at least two concentric hollows.

11. A displacement machine as defined in claim 1 wherein said sealing means includes a separate sealing element for each of said displacement surfaces, said sealing element being retained in linear engagement with said associated displacement surface.

12. A displacement machine as defined in claim 1, and further comprising a clamping ring for retaining said sealing means in engagement with said displacement surfaces.

13. A displacement machine as defined in claim 12, and further comprising resilient means arranged between said clamping ring and said sealing means for individually loading said sealing means.

14. A displacement machine as defined in claim 11 wherein each of said sealing elements is defined by opposing sides of larger dimensions provided with sealed pockets of about a same size, said sealing element having hydrostatic relief bores connecting said pockets.

15. A displacement machine as defined in claim 4, and further comprising an elastic element, each of said sealing elements being parted rectangular to its longitudinal axis and embracing said elastic element in axial direction.

16. A displacement machine as defined in claim 4 wherein said sealing elements are connected to a one-piece molding.

17. A displacement machine as defined in claim 16 wherein said sealing elements are connected to a one-piece molding via elastic webs.

18. A displacement machine as defined in claim 1 wherein said displacement body is driven in contactless manner and contains permanent magnets.

19. A displacement machine as defined in claim 2 wherein said displacement body is provided with rectilinear displacement surfaces.

20. A displacement machine as defined in claim 2 wherein said displacement body is provided with circular arc shaped displacement surfaces.

* * * * *